US008657144B2

(12) United States Patent
Kells

(10) Patent No.: US 8,657,144 B2
(45) Date of Patent: Feb. 25, 2014

(54) PORTABLE WORK BENCH PAINT TRAY WITH STAIR ADAPTOR

(76) Inventor: Steven R. Kells, North Huntington, PA (US)

( * ) Notice: Subject to any disclaimer, the term of this patent is extended or adjusted under 35 U.S.C. 154(b) by 0 days.

(21) Appl. No.: 13/541,952

(22) Filed: Jul. 5, 2012

(65) Prior Publication Data

US 2013/0037552 A1 Feb. 14, 2013

Related U.S. Application Data

(60) Provisional application No. 61/521,427, filed on Aug. 9, 2011.

(51) Int. Cl.
*B05C 21/00* (2006.01)

(52) U.S. Cl.
USPC ..... 220/570; 220/629; 220/630; 220/636

(58) Field of Classification Search
USPC ..... 220/629, 630, 636, 628, 570, 633; 248/688, 148, 149, 151, 127, 128, 248/213.2, 110, 111; 403/375, 381, 331; 108/157.1, 157.15, 157.16, 158.12
See application file for complete search history.

(56) References Cited

U.S. PATENT DOCUMENTS

| | | | | | |
|---|---|---|---|---|---|
| 80,289 | A | * | 7/1868 | Leavitt | 108/158.12 |
| 2,917,764 | A | * | 12/1959 | Whittle | 15/257.06 |
| 4,102,468 | A | * | 7/1978 | Goldman | 220/630 |
| D303,467 | S | | 9/1989 | Pepitone | |
| 4,889,254 | A | * | 12/1989 | Vola | 220/23.4 |
| 4,890,353 | A | * | 1/1990 | Shannon et al. | 15/257.01 |
| 5,217,193 | A | * | 6/1993 | Drucker | 248/148 |
| 5,240,214 | A | * | 8/1993 | Birnbaum et al. | 248/231.41 |
| 5,249,397 | A | * | 10/1993 | Monaco | 52/126.1 |
| 5,474,271 | A | * | 12/1995 | Raymond | 248/237 |
| 5,624,093 | A | | 4/1997 | Gemmell | |
| 5,746,345 | A | | 5/1998 | Zurawin | |
| 5,785,003 | A | * | 7/1998 | Jacobson et al. | 119/496 |
| 5,820,091 | A | * | 10/1998 | Kutscher | 248/220.21 |
| 5,913,782 | A | * | 6/1999 | Monaco et al. | 52/126.1 |
| 6,543,680 | B1 | * | 4/2003 | McCormack | 232/39 |
| 6,543,733 | B1 | * | 4/2003 | Pennington | 248/149 |
| 6,729,685 | B1 | * | 5/2004 | Ebalobor | 297/14 |
| D548,417 | S | | 8/2007 | Kohn | |
| 7,527,164 | B1 | | 5/2009 | Reichborn | |
| 2001/0013518 | A1 | * | 8/2001 | Lallement et al. | 220/570 |
| 2006/0064843 | A1 | | 3/2006 | Cornelissen | |
| 2007/0163974 | A1 | * | 7/2007 | Lai | 211/85.3 |
| 2008/0029520 | A1 | | 2/2008 | Hucks | |
| 2008/0127443 | A1 | * | 6/2008 | Blanchard | 15/257.06 |
| 2009/0050632 | A1 | * | 2/2009 | Martin | 220/570 |
| 2009/0173849 | A1 | | 7/2009 | Rose et al. | |
| 2010/0200596 | A1 | * | 8/2010 | Wallace | 220/570 |

* cited by examiner

*Primary Examiner* — Anthony Stashick
*Assistant Examiner* — Robert Stodola
(74) *Attorney, Agent, or Firm* — McKay & Associates, P.C.

(57) ABSTRACT

A tray for use during painting includes a stair adaptor for leveling the tray along stairs and maintaining the tray on a workbench. The tray body has at least one utility recess defined therein for situating paint cans, paint stirrers, and paint brushes. A roller tray is further defined within the tray body. A front cut-out is defined along the front which is well-suited to allow the tray to be secured to a workbench by way of workbench swivel pegs. Slots are defined within the underside traveling an entire width of the tray body. A stair adaptor is adapted to engage the slots. As a result, upon placement of the tray body on an upper step of a stairway the stair adaptor levels the tray while the base of the stair adaptor rests on an adjacent lower step.

12 Claims, 5 Drawing Sheets

PORTABLE WORK BENCH PAINT TRAY WITH STAIR ADAPTOR

CROSS-REFERENCE TO RELATED APPLICATIONS

The instant application claims benefit of provisional application Ser. No. 61/521,427 filed Aug. 9, 2011, the disclosure of which is herein incorporated by reference.

BACKGROUND

1. Field of the Invention

The instant invention relates to organizational trays. In particular, described is a tray for holding paint and utensils.

2. Description of the Related Art

Various tools and brushes for exterior and interior painting are obviously known in the art. So too are different types of trays and roller pans for containing and rendering easily-accessible the paint used for the project, as well as the brushes, cans, and rollers. For instance U.S. Pat. No. D303,467 shows a paint tray having a recess for holding a paint can. The tray itself is recessed to hold various painting tools. U.S. Pat. D548,417 to Kohn shows a similar recess within a paint tray, further including a recess defined within the tray for holding a roller. FIG. 1 of U.S. Pat. No. 5,746,345 also shows a paint brush recess within a rolling tray.

Standard also are workbenches, designed typically as flat, sturdy tables. Design may be varied according to their inclusion of means for fixing workpieces, means for storing tools, or by including features which allow the bench's height to be varied, among others. Workbenches are also commonly used by painters to hold or support the aforementioned trays, cans, and brushes.

Furthermore, different types of trays perform various functions and are adapted to be used at various locations. U.S. Patent Publication 2009/0173849 to Rose et al. teaches a holder for a paint container which can be used on uneven surfaces. The holder includes a base and at least one leg selectively positionable for fixing the angle of the leg. U.S. Pat. No. 5,217,193 to Drucker relates to a paint can holder for use on an angled roof.

There is a need then for a tray which can be used at alternative locations such as within a stairwell or on a staircase and but which is still compatible with typical painting and repair equipment.

SUMMARY

It is the objective of the instant invention to provide a paint tray which is compatible with various workbenches.

It is further the objective to provide a pain tray which can be used within a stairwell or on unlevel stair surfaces.

It is further an objective of the instant invention to provide a paint tray which is multi-functional.

Accordingly, the instant invention comprehends a tray for use during painting, which includes a tray body having an outer perimeter, an underside, a left side, a right side, a front, and a back. At least one utility recess is defined within the tray body with each utility recess performing various functions including the ability to situate paint cans, paint stirrers, and paint brushes. A roller tray is defined within the tray body angling downward from the front to the back. A front cut-out is defined along the front which is well-suited to allow the tray to be secured to a workbench by way of the workbench swivel pegs. A side cut-out is defined within the right side of the tray body. A slot is defined within the underside traveling an entire width of the tray body. A stair adaptor, further comprising a base; a pair of tubular leg seats upstanding from the base; an adaptor surface; a mating member integrally attached to the adaptor surface, the mating member shaped substantially similar to a shape of the slot and configured to slidably engage with a respective one of the slots on the underside; and a pair of adaptor legs extending downward from the adaptor surface configured to be received within the tubular leg seats. As a result, upon placement of the tray body on an upper step of a stairway the stair adaptor levels the tray while the adaptor base rests on an adjacent lower step. A least one locking bar is shaped to engage an end of the mating member such that upon engagement by friction the mating member can be locked in place to secure the stair adaptor.

DETAILED DESCRIPTION OF THE PREFERRED EMBODIMENT

Figure 1:
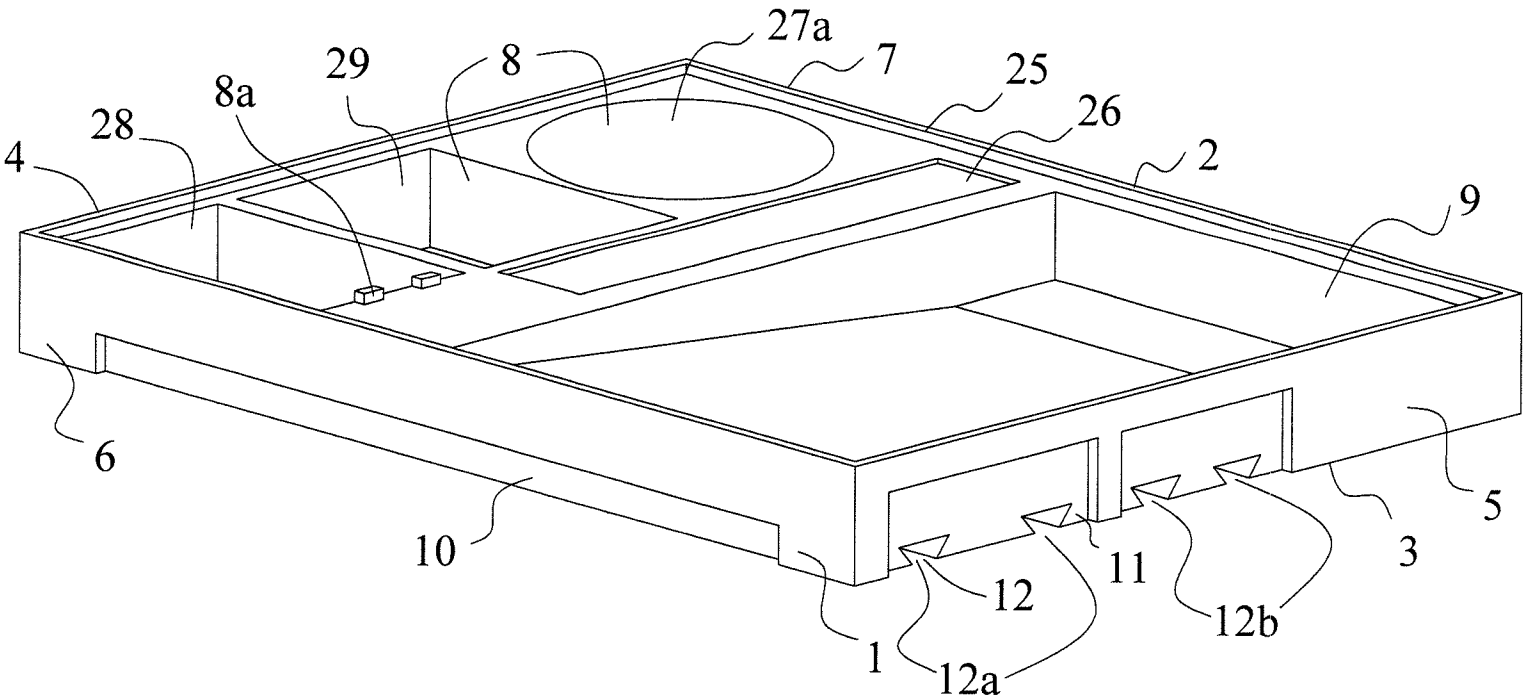
FIG. 1 shows a perspective view of the instant tray.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention. "A" or "an" as used in the disclosure and claims may mean one or more.

With reference then to FIGS. 1-5, shown is the instant tray. Tray has a tray body 1, an outer perimeter 2, an underside 3, a left side 4, a right side 5, a front 6, and a back 7. Although the overall shape of the tray body 1 may vary, it preferably is formed generally as a rectangle in the preferred embodiment since it is well-suited to be situated on workbenches, as further described. A disposable tray liner 24 can be used which will conform to the shape of the tray body 1.

Traveling around the outer perimeter 2 is raised edge 25. Raised edge 25 is raised to upstand vertically around the edge so as to contain paint drips and spills.

Tray body 1 includes multiple recesses, which are preferably indentations defined downward into tray from its top, hereinafter defined collectively as "utility recesses 8". Each utility recess 8 is defined within the tray body 1 and performs various functions. For one, defined within tray body 1 is a paint stirrer recess 26 formed as a shallow pocket wherein a wooden paint stirrer or similar can be situated. Paint stirrer recess 26 as shown is generally rectangular to conform or be similar to the typical size and shape of a paint stirrer. Another utility recess 8 is the paint can recess 27*a*, generally circular to contain a container such as a paint can. A paint brush recess 28 is further defined within tray body 1 to, in one embodiment, hold a paint brush, but it can be used to secure any article if need be. Of note is that a brush grip 8*a* is formed adjacent to the top edge of the paint brush recess 28. The brush grip 8*a* preferably includes a pair of opposing, raised tabs which are spaced to define a slot which can be used to contain the small handle affiliated with a paint brush. In this manner the brush end resides over the paint brush recess 28 to contain any drips. A trim tray recess 29 is also defined within the tray body 1, which can contain small amounts of paint and is typically the larger recess relative to the paint brush recess 28. Lastly, a roller tray 9 is defined within the tray body 1, optionally angling downward from the front 6 to the back 7, enabling the tray to be used with a roller.

Now to the front 6 of the tray body 1 with continued reference to FIGS. 1-4, defined therein is a front cut-out 10. Although not shown, an additional and identical cut-out is provided on the back 7 of the tray. Each cut-out 10 travels most of the length of the tray body 1 but not quite up to the raised edge 25 of tray body 1. Front cut-out 10 is the area in which work bench swivel pegs 23 may abut, as will be further described with reference to FIG. 3.

A pair of side cut-outs 11 is defined within the right side 5 of tray body 1, which will aid in the implementation of the stair adaptor 13, namely serving as the receiver for the locking bar 19. An additional pair of matching side cut-outs (not shown) can reside within the left side 4 of tray body 1. Further in conjunction with the stair adaptor 13, one or more a slots 12 is defined in the underside 3 of the tray body 1 traveling the entire length of the tray body 1. More specifically, defined in the underside 3, a pair of front slots 12*a* are proximate to the front 6 and a pair of central slots 12*b* are defined central to the tray body 1. The front slots 12*a* terminate at one of the side cut-outs and the central slots terminate at the other of the side cut-outs 11. As shown, each slot 12 in cross-section is generally of an inverted trapezoid shape but may vary depending on the shape of the stair adaptor 13, as further described.

Figure 2:
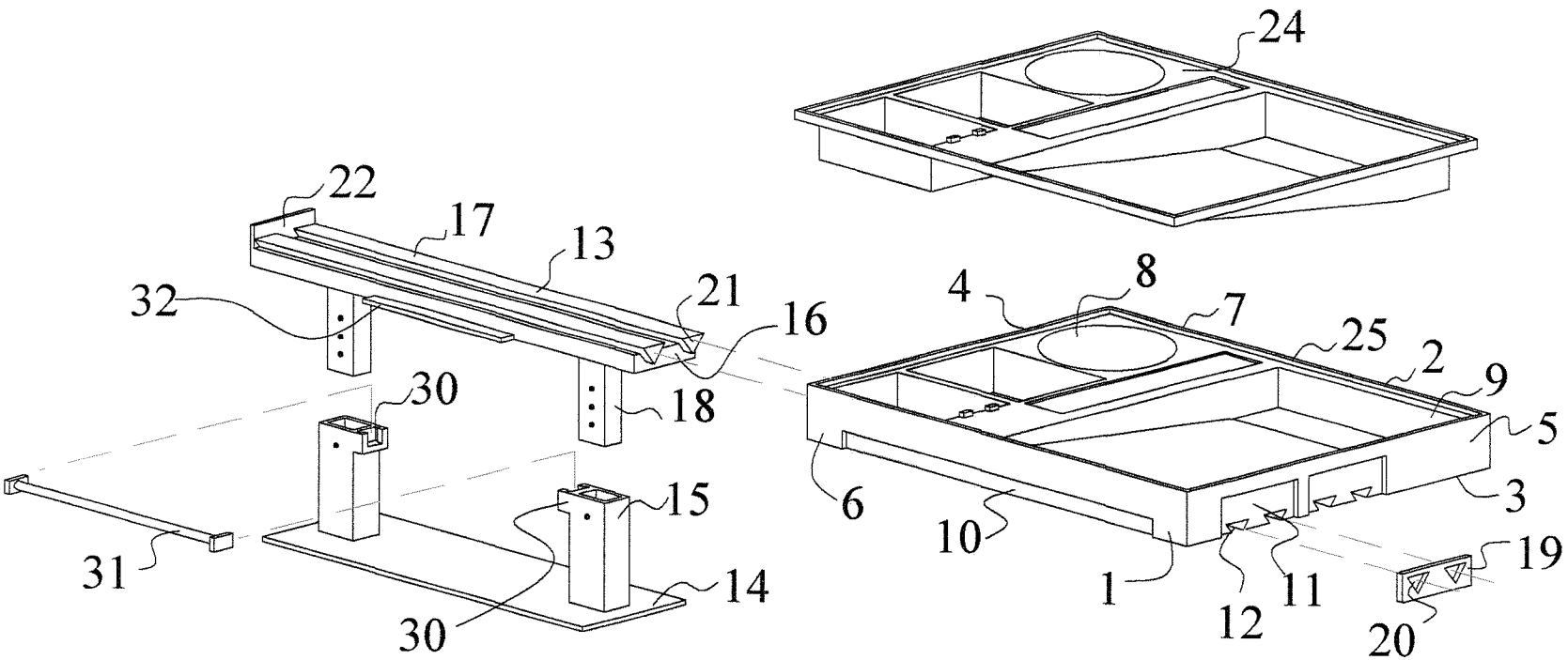
FIG. 2 shows an exploded perspective view of the instant tray along with the system's additional components.

FIG. 2 details the stair adaptor 13 for use in conjunction with the tray body 1. The stair adaptor 13 includes a base 14, which is a flat platform dimensioned to fit a stair. A pair of tubular leg seats 15 upstand perpendicularly from the base 14. An adaptor surface 16 longitudinal in nature forms the support for a variety of components. Namely, a mating member 17 is integrally attached to the adaptor surface 16, the mating member 17 shaped substantially similar to a shape of the slot 12 on the underside 3 of the tray body 1. "Substantially similar" in this context means the shape of the mating member 17 is identical to the shape of the slot 12 but for the portion of the mating member that would not reside in the slot and the slight dimensional variance of the mating member 17 to allow the mating member 17 to fit within the slot 12. The mating member 17 therefore is configured to slidably engage with a respective one of the slots 12 on the underside 3. Then a pair of adaptor legs 18 extends downward from the adaptor surface 16. The adaptor legs 18 are configured to be received within the tubular leg seats 15 and be temporarily fixed into position using any type of pin such as a cotter pin. As a result, upon placement of one half of the tray body 1 on an upper step of a stairway, the stair adaptor 13 while engaged to and supporting the other half of the tray body 1, levels the tray body 1 while the adaptor base 14 rests on an adjacent lower step (see FIG. 5). "One-half" as herein defined means the underside 3 of the tray body 1 which extends away from the center most slot. The other half would therefore be the opposing half which includes the slots 12.

A locking bar 19 is shaped with defined female hollow portions 20 to engage an end 21 of the mating member 17. In this manner, upon engagement by the female hollow portion 20 member by friction to the mating member 17, the stair adaptor 13 can be temporarily locked in place to secure the stair adaptor 13 underneath the tray body 1 as raised stopping edge 22 of adaptor surface 16 abuts the opposite side of tray body 1, namely disposed within the opposing cut-outs which mirror the side cut-outs 11 but on the left side 4 as mentioned above. Shown herein the locking bar 19 is a rectangular plate, but this shape may vary as long as it conforms to the side cut-out 11 because the locking bar 19 embeds itself into the side cut-out 11. The shape of female hollow portion 20 may also vary but match the shape of each end 21 of the mating member 17.

Figure 5:
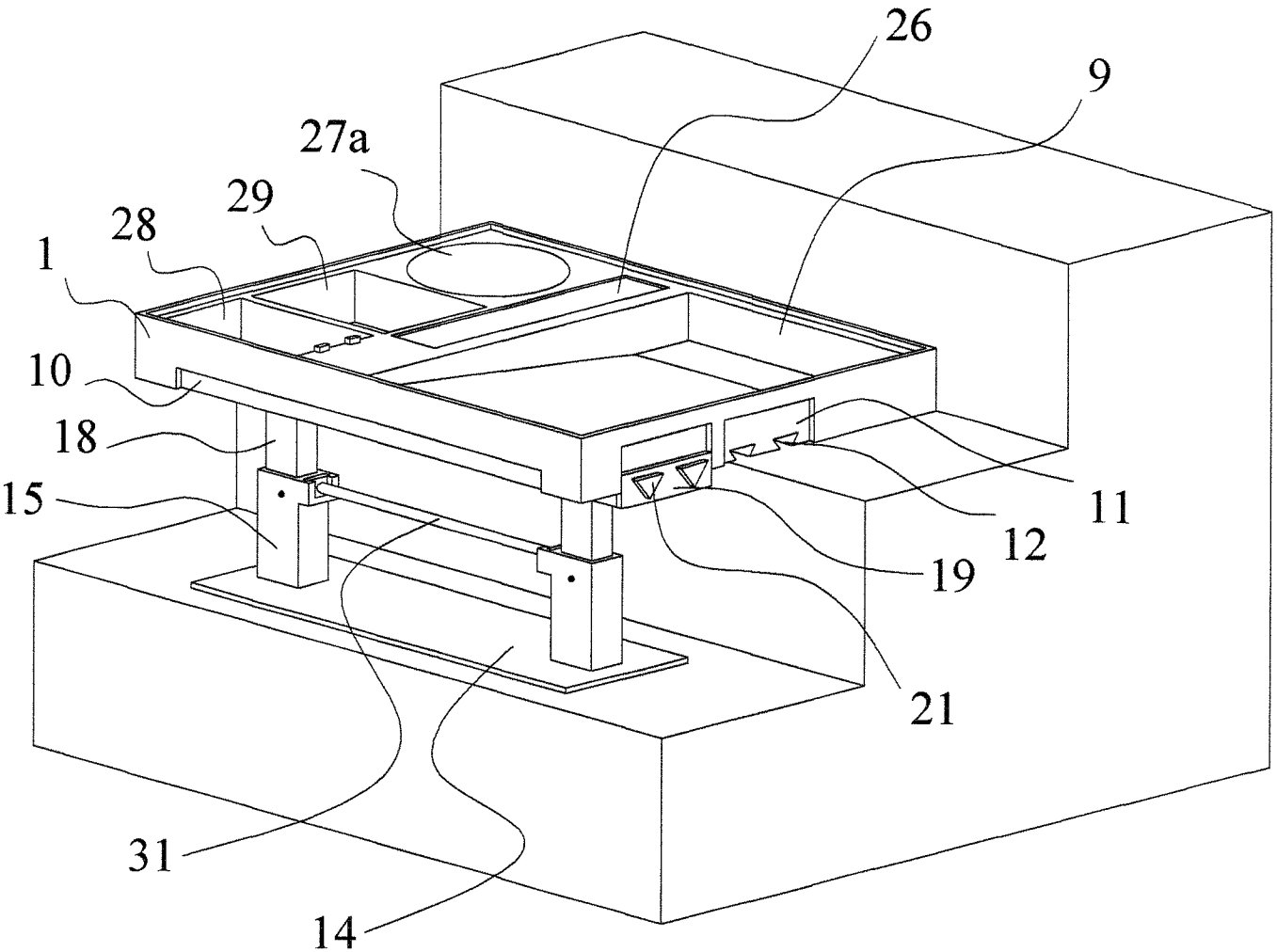
FIG. 5 shows a perspective view of the instant tray in use along a staircase.

As an additional feature and with further reference to FIGS. 2 and 5, each adaptor leg 18 has formed integrally thereto an adaptor seat 30 formed as an extension at the top thereto. Each adaptor seat 30 has defined therein a cavity. A dowel rod 31 having two ends can therefore rest on the adaptor legs 18 spanning the distance between the adaptor legs 18 as each end sits within each respective cavity. As a result the dowel rod 31 can be used to hold towels, paper towels, or other similar draping articles.

Figure 3:
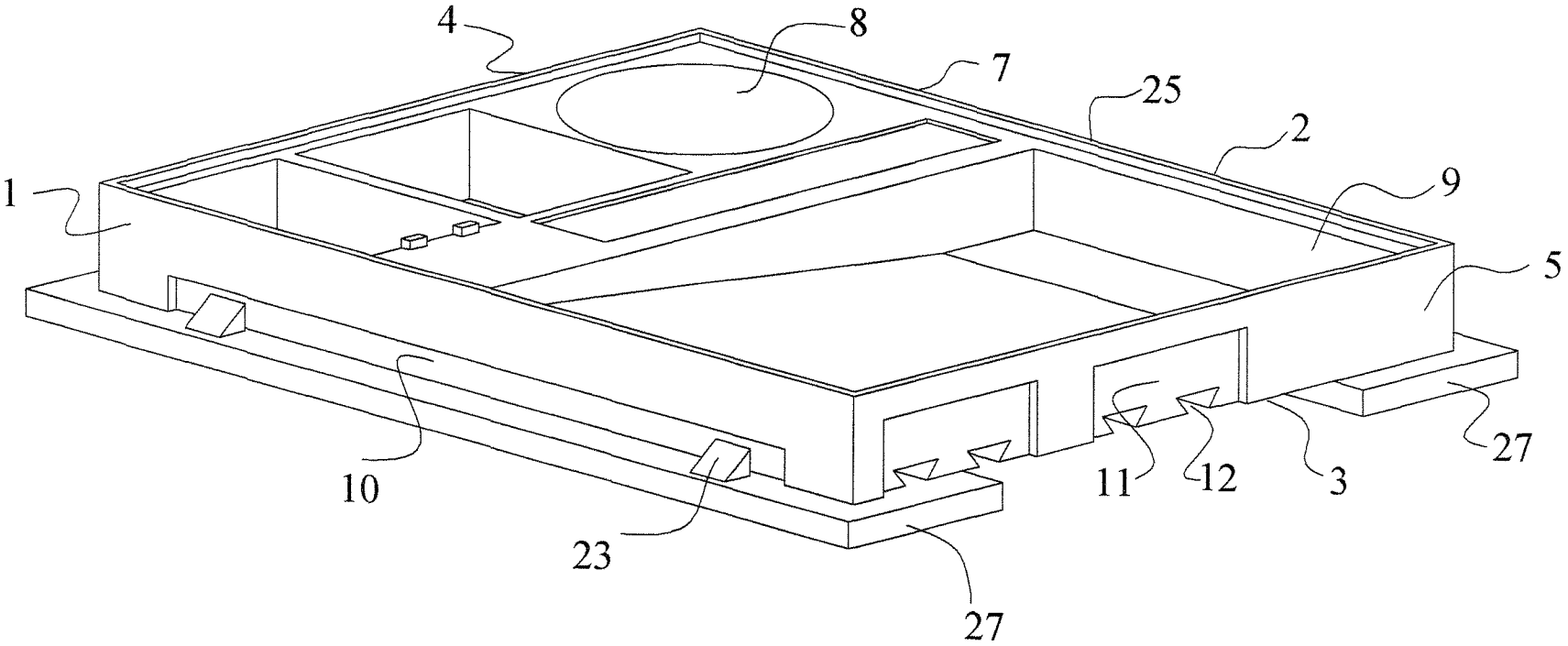
FIG. 3 shows a perspective view of the instant tray in use on a workbench surface.
Figure 4:
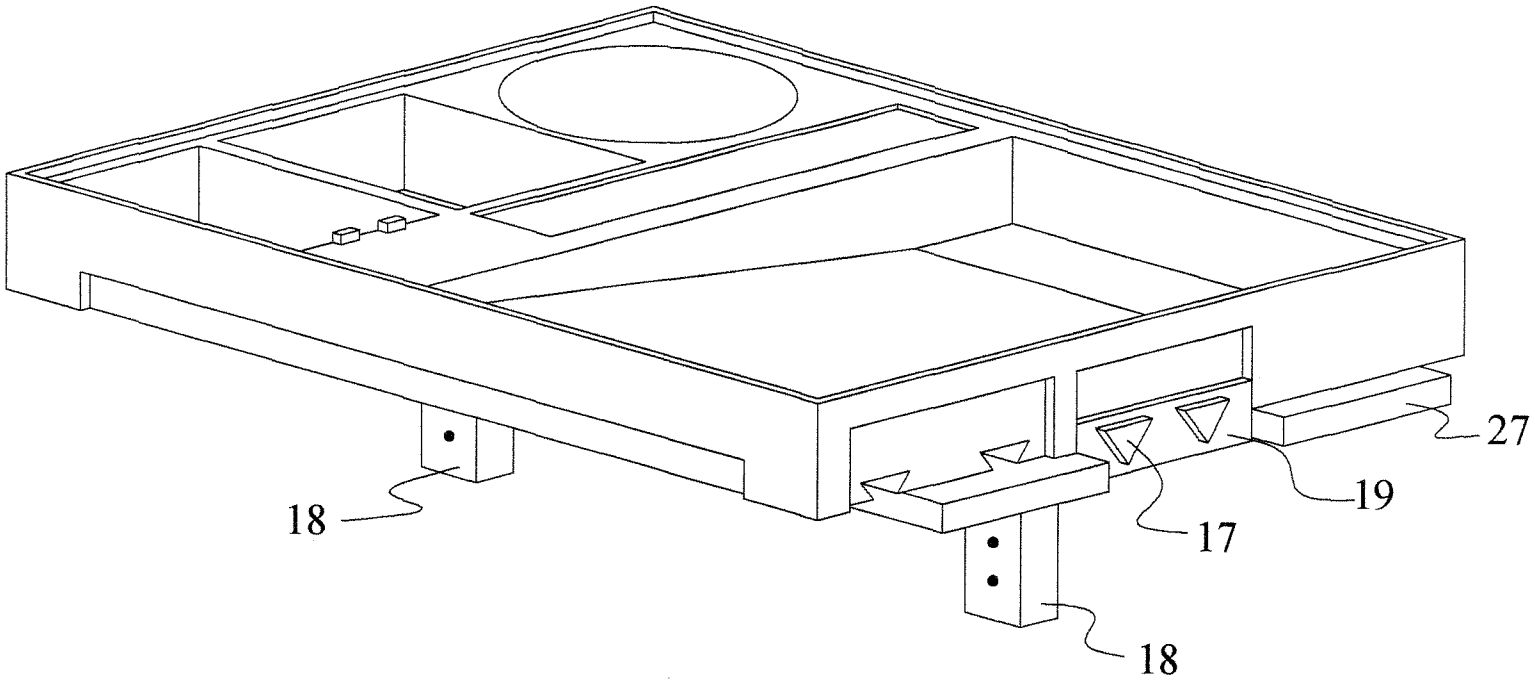
FIG. 4 shows another perspective view of the tray on a workbench with the stair adaptor aiding in its placement.

With particular reference to FIGS. 3 and 4, the tray body 1 is especially suited to be situated on a workbench 27 as desired. This is allowed by way of the flat underside 3, the stair adaptor 13, and/or the rear and front cut-out 10. Each cut-out 10 is adapted to have abutted therein one or more swivels pegs 23. As known, swivel pegs 23 are interchangeable projections which can be inserted into the workbench 27. As such the dimensions of the workbench 27 are changed and therefore the instant tray can be located on the workbench 27 without sliding of its surface.

In the embodiment above, the slots 12 which are most proximate to the front 6 would typically be used when the tray is in use on a stair (see FIG. 2) using the stair adaptor 13. However, the stair adaptor 13 is also used in conjunction with a workbench 27 having small dimensions by utilizing the slots 12 which are most central to the tray body 1. Some smaller work benches do not open wide enough for an object to fit between the swivel pegs 23. FIG. 4 shows the stair adaptor 13 (hidden from view) engaged with its mating members 17 to the underside 3 of the tray body 1 with its adaptor legs 18 disposed downward. In this manner the stair adaptor 13 provides a securement mechanism for the tray to be used on a workbench 27 where the workbench here is very narrow. Although the tray body 1 overhangs the small workbench 27, the tray body 1 is made more secure on the surface of the workbench 27 because the stair adaptor 13 with its adaptor legs 18 prohibit the sliding of the tray body 1 as the stair adaptor 13 and adaptor legs 18 reside within and through the parallel clamping boards of the workbench 27. Furthermore, stair adaptor 13 includes lower lip 32 formed as an oblong flange on the front and back (not shown) of the adaptor surface 16. When the stair adaptor 13 is used to secure the tray body 1 on the workbench 27, the lower lip 32 will abut against the underside of the parallel clamping board of the workbench 27, thus preventing the tray body 1 from tilting or being lifted out of the workbench 27. Thus, the stair adaptor 13 provides two functions, namely stability on a stairwell (see FIG. 5) and stability on small workbench surfaces (see FIGS. 3 and 4).

I claim:

1. A tray, comprising:

a tray body having an outer perimeter, an underside, a left side, a right side, a front, and a back;

at least one utility recess defined within said tray body;

a roller tray defined within said tray body traveling from said front to said back;

a front cut-out defined along said front;

a pair of side cut-outs defined within said right side of said tray body;

multiple slots defined within said underside traveling an entire width of said tray body including a pair of front slots proximate to said front and a pair of central slots central to said tray body, wherein said front slots terminate at one of said side cut-outs and said central slots terminate at the other of said side cut-outs;

a stair adaptor, further comprising:

a base;

a pair of tubular leg seats upstanding from said base;

an adaptor surface;

a mating member integrally attached to said adaptor surface, said mating member shaped substantially similar to a shape of each said slot and configured to slidably engage with a respective one of said slots on said underside;

a pair of adaptor legs extending downward from said adaptor surface, wherein said pair of adaptor legs are configured to be received within said tubular leg seats, and wherein said pair of adaptor legs are sized to be accommodated within a pair of parallel clamping members of a workbench;

wherein upon placement of said tray body on an upper step of a stairway said stair adaptor engages only said front slots and levels said tray while said adaptor base rests on an adjacent lower step;

wherein upon placement of said tray body on said workbench said stair adaptor engages only said central slots to prohibit said tray body from sliding off said workbench; and, at least one locking bar, said locking bar having defined therein a female hollow portion, said locking bar sized to be accommodated within each said side cut-out and said female hollow portion.

2. The tray of claim 1, wherein said stair adaptor further comprises a stopping edge raised from said adaptor surface opposite said end of said mating member for abutting said left side of said tray body.

3. The tray of claim 1, wherein said stair adaptor further comprises a means for raising and lowering said adaptor surface relative to said base.

4. The tray of claim 1, wherein said front cut-out is adapted to receive a swivel peg of a workbench for securing said tray body to said workbench.

5. The tray of claim 1, further comprising a raised edge formed along said outer perimeter.

6. The tray of claim 1, wherein said utility recess is shaped to situate a paint can.

7. The tray of claim 1, wherein said utility recess is sized to contain paint drips.

8. The tray of claim 1, further comprising a brush grip for securing a paint brush over one of said utility recesses.

9. The tray of claim 1, wherein said utility recess is shaped to situate a paint stirrer.

10. The tray of claim 1, wherein each said tubular leg seat of said base has defined therein a groove at a top thereof.

11. The tray of claim 10, further comprising a dowel rod having two rod ends, wherein each said rod end is adapted to seat within said groove to maintain said dowel rod in a raised and horizontal position.

12. The tray of claim 1, wherein said stair adaptor includes a pair of lower lips formed as oblong flanges on the adaptor surface adapted to abut undersides of said parallel clamping members of said workbench.

* * * * *